United States Patent [19]

Asp

[11] 4,293,032

[45] Oct. 6, 1981

[54] COMBINATION FORCED AIR FURNACE AND AIR COOLER

[76] Inventor: Donald J. Asp, 1140 E. Hawthorne, St. Paul, Minn. 55106

[21] Appl. No.: 100,738

[22] Filed: Dec. 6, 1979

[51] Int. Cl.[3] ..... F23F 27/02

[52] U.S. Cl. ..... 165/101; 165/122; 165/137; 62/326

[58] Field of Search ..... 165/27, 122, 137, DIG. 16, 165/100, 101, 103; 62/326

[56] References Cited

U.S. PATENT DOCUMENTS

| | | | |
|---|---|---|---|
| 2,139,262 | 12/1938 | Evwer | 165/137 X |
| 2,776,118 | 1/1957 | Davis | 165/122 X |
| 3,749,157 | 7/1973 | Davison | 165/137 X |
| 3,813,039 | 5/1974 | Wells | 165/122 X |

*Primary Examiner*—Albert W. Davis
*Assistant Examiner*—Margaret A. Focarino
*Attorney, Agent, or Firm*—Jacobson and Johnson

[57] ABSTRACT

A single housing contains heating and air cooling units but in separate chambers and a single blower is selectively movable to force air into and through the respective chambers as desired for cooling or heating and outlets from the separate chambers to a common plenum are closed off depending upon which of the chambers is being fed by the blower.

5 Claims, 2 Drawing Figures

COMBINATION FORCED AIR FURNACE AND AIR COOLER

BACKGROUND OF THE INVENTION

This invention relates to a combination forced air furnace and air cooler or conditioner. In the past where a single unit was used in a forced air system to selectively provide heating or cooling, elements of the cooling unit, such as the cooling coils, have been located in the path of the flow of the heating air even when they are not in use for cooling. This interferes with the flow of the heating air and naturally makes the heating less efficient and requires a larger blower to force the heating air through the resistance of the cooling coils. Similarly, elements of the heating unit might be in the path of the air flow when the cooling unit is in use.

SUMMARY OF THE INVENTION

This invention provides a single main housing, a single blower and a single outlet plenum for selectively providing forced air heating or cooling. The main housing is partitioned into two chambers, one containing elements of the cooling unit, such as cooling coils for air conditioning and the other containing elements of the heating unit. A single blower is movable between two positions to provide forced air into one of the two selected chambers through a suitable inlet opening. A separate opening at the output of each of the chambers is also provided into a common plenum for carrying the forced air into the house or building ducts. When the blower is moved to the desired location, the corresponding outlet opening from the chamber to be used is opened and the outlet opening from the unused chamber is closed so that the air is directed from the selected chamber into the plenum without having to go through or around any of the elements of the unit contained in the other chamber.

In one embodiment of the invention a pivotally mounted, counter-balanced damper is located at the outlet opening from one of the chambers into the plenum. If that chamber is selected, the air from the blower forces the damper open to permit flow of the air into the plenum and at the same time closes the air-flow path in or to the plenum from the other chamber. When the other chamber is selected, the damper closes the outlet opening of the first chamber so that the air flows freely from the selected other chamber into the common plenum and no air flows through the unselected chamber.

In another embodiment a mechanism is provided so that when the blower is physically moved from the input or inlet opening of one of the chambers to the input opening of the other chamber, correspondingly the outlet opening from the selected chamber is opened and the outlet opening from the unselected chamber is automatically closed with a closure plate.

DESCRIPTION OF THE PREFERRED EMBODIMENTS

Figure 1:
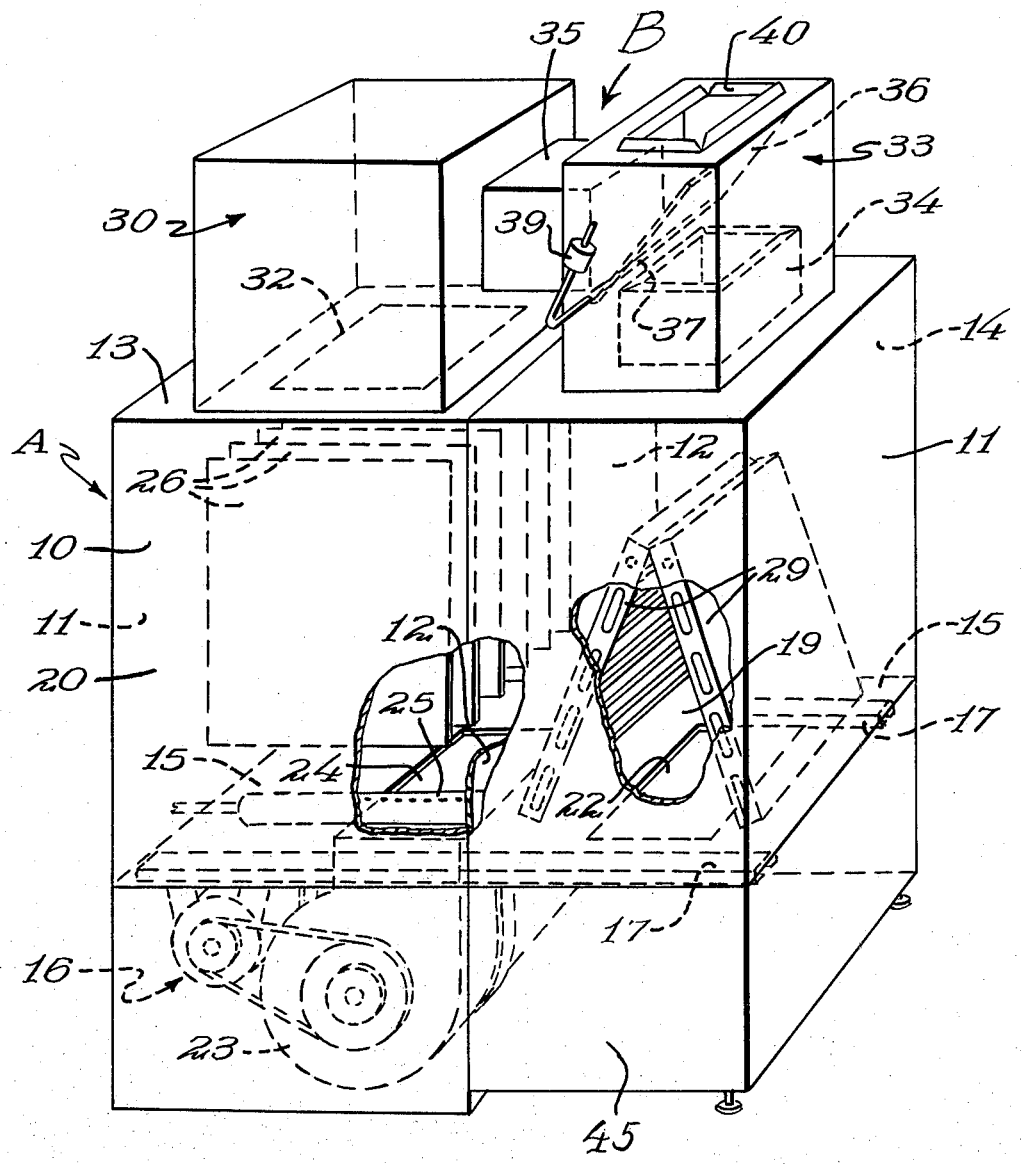
FIG. 1 is a diagramatic perspective view showing an embodiment of the invention.

In the two figures like elements are identified with the same reference numerals.

Referring first to FIG. 1, the outer housing is indicated in general by the letter A. Preferably, it is generally rectangular in shape, similar to the outer housing of present day conventional forced air gas furnace boxes, having a front wall 10, parallel sidewalls 11 and a rear wall 14 parallel to the front wall 10 which connects the rear edges of the side walls 11 and a top wall or cover 13. The main housing A also contains a false bottom plate 15 which is parallel to the top or cover wall 13 elevated above the bottom of the housing A to form a compartment 45 containing a forced air blower unit 23 which may be driven in conventional fashion through a belt and pulley arrangement by an electric motor 16. Extending vertically downward from the approximate center of the top wall 13 to the false bottom 15 is a partition wall 12 which forms two chambers 19 and 20. In general, the two chambers 19 and 20 are equal in size but no limitation thereto is intended and the size is a matter of choice or design. Chamber 19 is designated as the cooling chamber and 20 is designated as the heating chamber. In the past, conventionally, component parts of the heating unit and the cooling unit, such as cooling coils, were contained in the same single chamber. In the instant invention, although still contained with a common main housing, the conventional cooling unit elements, such as coils 29 which are normally coupled to a compressor, not shown, are contained in the cooling chamber 19 and the conventional elements of a heating unit, such as burner 25 and heating plates 26, are contained in the heating chamber 20.

A plenum B is mounted on the top side of the main housing A and consists of three main parts, box 30 located above the heating chamber 20, box 33 located above the cooling chamber 19, and conduit 35 providing communication between box 30 and 33. An opening 40, at the top of box 33, provides communication from the plenum B to the ductwork, not shown, which carries the forced air coming out of the main housing A to the home or building for heating or cooling. An opening 32 in the top wall 13 provides an outlet for forced air coming out of the heating chamber 20 into the plenum box 30 and a passage 34 through the top wall 13 similarly provides an outlet for forced air coming out of the cooling chamber 19 into the plenum box 33. A damper plate 36 is pivotally mounted on shaft 37 which extends through the walls of the plenum box 33. The shaft 37 is normally biased by a counterweight 39 to place the damper plate 36 over the passage 34 to keep it in the closed position or may merely keep the damper plate 36 inclined, as illustrated in FIG. 1. In any event, the damper plate 36 can be pivotally swung to open passage 34 and close off the opening into plenum box 33 from the connecting conduit 35 or to close off passage 34 and open the air flow path through conduit 35.

Mounted on the underside of the false bottom 15 is a set of parallel, horizontal tracks 17 on which the blower 23 and its associated motor 16 are mounted. The mounting can be in any conventional fashion and is merely a matter of choice easily designed or selected by one of ordinary skill in the art so no details thereof are shown. The only requirement is that the mounting be such that blower 23 can be selectively positioned as desired along the tracks 17. An opening 22 in the false bottom 15 provides an inlet for forced air from the blower 23 into the cooling chamber 19 and a similar opening 24 in the false bottom 15 provides an inlet for forced air from the blower 23 into the heating chamber 20.

In operation, assuming the blower 23 is positioned along tracks 17 to force air through the opening 24 into the heating chamber 20, the air after being heated will pass through the outlet opening 32 through the plenum B and the opening 40 to heat the building. The damper plate 36 will be swung to close the passageway 34 by the force of the air coming from the heating chamber 20. If the blower 23 is positioned to provide forced air into the cooling chamber 19, the force of the air passing through the passageway 34 will swing the damper plate 36 to close off the flow of air from or to plenum box 30 and will allow the passage of the cooling air out of the opening 40 into the building. In this fashion the positioning of the blower will automatically control the direction of the air flow by the operation of the damper. When the cooling unit is being used, there is no interference of air flow by any of the elements of the heating unit and correspondingly when the heating unit is in use the elements of the cooling unit do not interfere with the flow of the heating air into the building.

Figure 2:
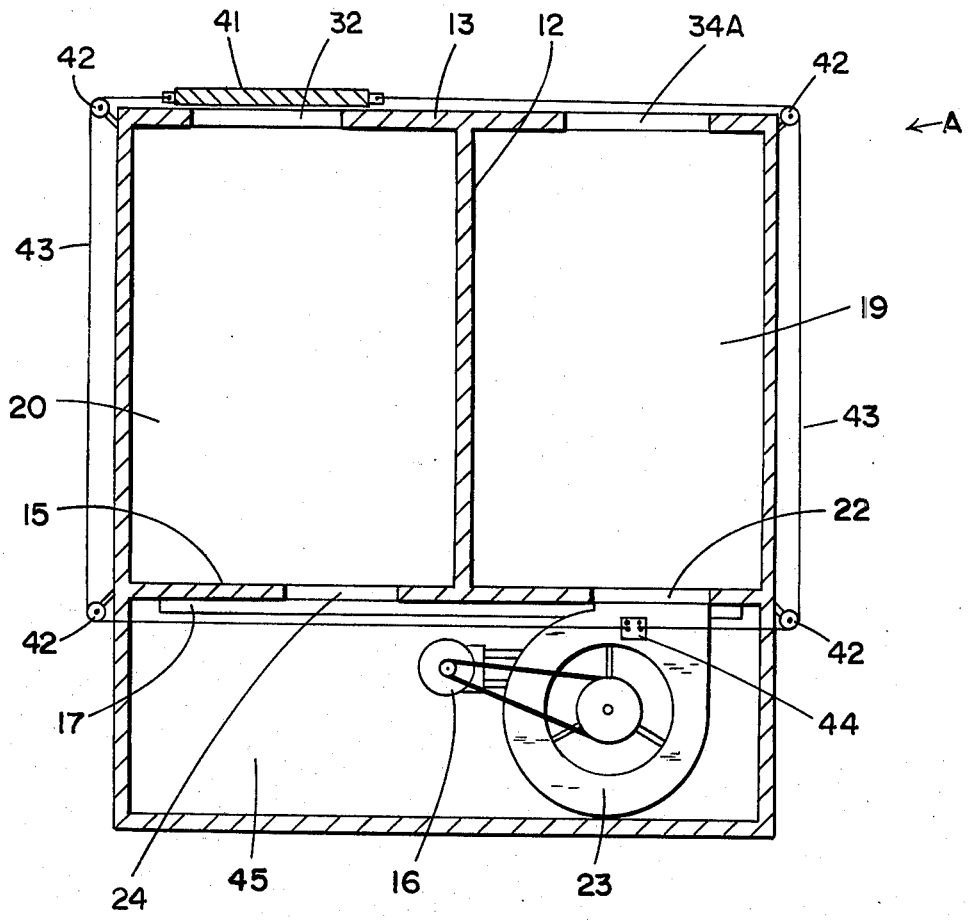
FIG. 2 is a simplified somewhat diagramatic elevational view showing a second embodiment of the invention.

Turning next to FIG. 2, another embodiment of the invention is shown. As stated earlier, elements which are similar to those contained in FIG. 1 are identified with the same reference numeral. The main housing A is divided into a cooling chamber 19 and a heating chamber 20 with a false bottom 15 forming a lower compartment 45 in which is located a blower 23 and its driving motor 16 suitable movably mounted on a set of tracks 17. An inlet opening 24 provides a passage for forced air from the blower compartment 45 into the heating chamber 20 and a similar opening 22 allows for air to travel from the blower compartment 45 into the cooling chamber 19. An opening 32 provides an outlet passage for air from the heating chamber 20 into a plenum (not shown) and a similar opening 34A, for the same purpose as passage 34 in FIG. 1, is provided in the top wall 13 to permit passage of air out of the cooling chamber 19 into the plenum. A coverplate, 41 which can be made of any suitable material, is mounted in any suitable fashion on cover wall 13 to be able to slide along the top of the housing A. The coverplate 41 is linked by two sets of pulleys 42 which are coupled by a pair of continuous chains or belts 43 to the blower 23 via a suitable mounting pad 44 so that when the blower 23 is moved it will cause the coverplate 41 to move. Details of the mounting pad 44 are not shown because one of ordinary skill in the art can readily design any suitable attachment for the intended purpose and the design is merely a matter of choice and does not constitute an integral part of the invention.

In operation, when the blower 23 is moved on its tracks 17 to be positioned to communicate through opening 22 into the cooling chamber 19 the coverplate 41 is moved into position to cover opening 32 to prevent any flow of air through the heating chamber 20. When the blower 23 is moved to be positioned to provide air into the heating chamber 20 through opening 24, the coverplate 41 is moved by the pulley-chain mechanism, elements 42 and 43, to slide to a position over opening **34*a* and to uncover opening 32 to allow the passage of air out of the heating chamber 20 into the plenum and prevent the passage of air through the cooling chamber 19**.

The invention is purposely illustrated by a drawing in diagramatic form as the specific details of the construction are less important than the general nature to provide the advantages and the features described. As can be observed from the written description and the drawing, it is clear that the heating and air cooling units are enclosed within a single main housing using a single blower unit but yet in separate chambers so that elements of one do not interfere with the flow of air when the other is in use. It can also be observed that a feature of the invention is that the invention can be implemented by relatively simple modifications of a presently existing combination furnace and air cooler unit in which both units are mounted in the same chamber by merely adding a separated chamber onto the present main housing, providing suitable inlet and outlet openings for the chamber, tracks upon which to mount the blower and the mechanism for automatically controlling the air flow as the blower is moved.

I claim:

1. A combination forced air furnace and cooling unit, comprising:

a. a main housing having a separate heating chamber, cooling chamber and a compartment containing a single blower;

b. a separate inlet opening for blowing air into said heating chamber and said cooling chamber from the blower;

c. a separate outlet opening for passing air out of said heating chamber and said cooling chamber to a common plenum;

d. means for selectively positioning said blower to blow air into the inlet opening of only one of said chambers; and e. means for automatically closing off the outlet opening from the other of said chambers to the common plenum when the blower is blowing air into said one chamber.

2. The invention as described in claim 1 wherein said means for automatically closing off the outlet opening comprises:

a damper plate pivotally mounted for closing off the outlet opening from one of said chambers when the blower is blowing air into the other of said chambers.

3. The invention described in claim 1 wherein said automatic closing means comprises: a movable coverplate and means linking said coverplate to said blower such that when the blower is positioned to provide air to the inlet of one of the chambers the coverplate is moved to close the outlet opening of the other chamber and the blower is moved to provide air to the inlet of the other chamber the coverplate is moved to close the outlet opening of the one chamber.

4. The invention as described in claim 1 wherein the blower compartment is located at the underside of the main housing; the cooling and heating chambers are located adjacent one another above the blower compartment and the outlet openings are located at the top of the respective chambers.

5. A combination forced air furnace and cooling unit, comprising:

a. a heating chamber containing a heating unit;

b. a separate adjacent cooling chamber containing a cooling unit;

c. a blower;

d. a separate air inlet opening for each of said heating and cooling chambers;

e. a separate air outlet opening for each of said heating and cooling chambers, both communicating with a common plenum;

f. means for selectively positioning the blower to provide air through an inlet opening to either the cooling or heating chamber; and g. means for automatically stopping communication of the outlet opening of the heating chamber to the plenum when the blower provides air to the cooling chamber inlet and for automatically stopping communication of the outlet opening of the cooling chamber to the plenum when the blower provides air to the heating chamber inlet.

* * * * *